United States Patent [19]

Fähnrich et al.

[11] Patent Number: 4,647,817

[45] Date of Patent: Mar. 3, 1987

[54] DISCHARGE LAMP STARTING CIRCUIT PARTICULARLY FOR COMPACT FLUORESCENT LAMPS

[75] Inventors: Hans-Jürgen Fähnrich; Ulrich Roll; Eugen Statnic, all of Munich, Fed. Rep. of Germany

[73] Assignee: Patent-Truehand Gesellschaft m.b.H., Munich, Fed. Rep. of Germany

[21] Appl. No.: 795,994

[22] Filed: Nov. 7, 1985

[30] Foreign Application Priority Data

Nov. 16, 1984 [DE] Fed. Rep. of Germany ..... 3441992

[51] Int. Cl.[4] ..... H05B 39/04

[52] U.S. Cl. ..... 315/104; 315/99; 315/100; 315/101; 315/105; 315/226; 315/244; 315/245; 315/DIG. 7; 315/207

[58] Field of Search ..... 315/99, 100, 105, 244, 315/245, 226, DIG. 7, 207, 104, 101

[56] References Cited

U.S. PATENT DOCUMENTS

| | | | |
|---|---|---|---|
| 2,212,427 | 8/1940 | Peters | 315/104 |
| 2,231,999 | 4/1941 | Gustin et al. | 315/100 |
| 3,836,817 | 9/1974 | Tschang | 315/104 |
| 3,882,354 | 5/1975 | May | 315/101 |
| 4,075,476 | 2/1978 | Pitel | 315/209 R |
| 4,256,991 | 3/1981 | Otala | 315/104 |
| 4,380,719 | 4/1983 | DeBijl | 315/244 |
| 4,406,976 | 9/1983 | Wisbey | 315/245 |
| 4,547,706 | 10/1985 | Krummel | 315/207 |

OTHER PUBLICATIONS

"Elektronikschaltungen" (Electronic Circuitry) by Walter Hirschmann, Berlin/Munich, Siemens Aktiengesellschaft, 1982, p. 148.

*Primary Examiner*—Harold A. Dixon

*Attorney, Agent, or Firm*—Frishauf, Holtz, Goodman & Woodward

[57] ABSTRACT

To provide for reliable ignition of low-pressure discharge lamps, particularly compact fluorescent lamps, operated at high frequency, for example in the order of about 45 kHz, an ignition circuit is connected in parallel to the lamp and serially with the electrodes (16, 17) thereof, which comprises a limiting capacitor (19) and the parallel circuit of a positive temperature coefficient (PTC) resistor (20) and a starting capacitor (18). The two capacitors (18, 19), together with an inductance (13, 14) in the operating circuit of the lamp, and a further capacity formed by a blocking capacitor (15), after preheating of the lamp electrodes by current flowing through the initially cold PTC resistor, will cause voltage rise across the resonance capacitors (18, 19) which will cause ignition of the lamp. The ratio of the limiting capacitor to the starting capacitor is in the order of 1:1 to 5:1, preferably about 2:1, resulting in gentle ignition in minimum time, for example about ½ second after energization of the lamp.

10 Claims, 4 Drawing Figures

DISCHARGE LAMP STARTING CIRCUIT PARTICULARLY FOR COMPACT FLUORESCENT LAMPS

Reference to related publications:

"Elektronikschaltungen" ("Electronic Circuitry"), by Walter Hirschmann, Berlin/Munich, SIEMENS Aktiengesellschaft, 1982, p. 148.

U.S. Pat. No. 2,231,999, Gustin et al.

The present invention relates to low-pressure discharge lamps, particularly fluorescent lamps, and especially to starting circuitry for compact fluorescent lamps with heatable electrodes, for example of the type described in U.S. Pat. No. 4,481,442, Albrecht et al., but without an integrated glow-type starter in the lamp base, assigned to the assignee of the present application.

BACKGROUND

Various types of operating circuits are known to operate and start fluorescent lamps. One type of circuit uses an inductance and a serially connected blocking capacitor, both connected in the current supply circuit of the lamp and, in the starting circuit, a starting capacitor to the lamp, that is, connected serially with the heating electrodes of the lamp. It has also been proposed—see the referenced U.S. Pat. No. 2,231,999—to provide a temperature-dependent resistor serially connected to the starting capacitor in the starting circuit.

Various starting circuits for low-pressure discharge lamps utilize a glow-type starter to preheat the lamp electrodes. The glow-type starter is connected in the ignition or starting circuit. It has been found that, upon first connecting the lamp, a glow discharge or flash occurs until the starter circuit operates and preheating begins. This glow discharge may be perceived in form of flicker, which is annoying and undesirable.

Compact fluorescent lamps, and fluorescent lamps in general of low power, may have starter and ballast circuitry integrated in the base of the lamp, or the socket therefor. The lamp is desirably operated at a frequency high with respect to power line frequency. High-frequency operation is suitable. High-frequency operation eliminates undesirable flicker and light variation of the lamp, particularly during ingition or starting. This flicker is effectively avoided by including a resonant circuit in the starting circuitry—see the referenced literature "Elektronikschaltungen" ("Electronic Circuitry") by Walter Hirschmann, Berlin/Munich, SIEMENS Aktiengesellschaft, 1982, p. 148.

By suitable selection of the capacitor in the resonance circuitry, it is possible to adjust the idle voltage of the lamp for desirable and optimum conditions, within certain limits. In compact fluorescent lamps, it is desirable to maintain the voltage on the resonant capacitor, and therefore on the lamp electrodes, at a level which is so low that, upon first connecting the lamp, the otherwise occurring glow discharge will not occur. On the other hand, however, the voltage, after sufficient preheating, should be so high that the lamp will reliably fire or ignite, even if ambient temperatures are low, and below usual "room temperature".

U.S. Pat No. 2,231,999, Gustin et al., describes a circuit arrangement for the ignition circuit of a fluorescent lamp utilizing a series circuit of a resonance capacitor and a temperature-dependent resistor. The temperature-dependent resistor is of the negative temperature coefficient type, that is, upon first connecting the resistor to electrical power, its resistance is high. As current flows through the resistor, and the resistor becomes hot, the resistance of the resistor decreases. In dependence on the characteristics of the NTC resistor, the lamp will, eventually, ignite or fire.

In the operation of this curcuit, initially, a small preheating current will flow. The preheating time of the lamp, thus, is long. At low ambient temperatures, the voltage across the lamp may not be sufficient to cause ignition reliably. After ignition, a relatively high current will flow through the ingnition circuit. This reduces the overall efficiency of the system, since continuous heating of the electrodes results only in wasting of power. Additionally, the electrodes may overheat, which leads to increased consumption of emission material customarily placed on the electrodes, which reduces the lifetime of the lamp and further decreases light output thereof due to blackening of the glass walls.

THE INVENTION

It is an object to provide a starting and operating circuit for a fluorescent lamp, particularly a low-power compact fluorescent lamp, to be connected in circuit and combined therewith, which does not use a glow-starting switch, reliably effects starting or ignition of the lamp within wide ranges of temperature, while protecting the lamp under all operating conditions, thus increasing the lifetime thereof. Additionally, the circuit should result in rapid and flicker-free ignition of the lamp without any distracting glow discharges.

Briefly, a starting circuit is provided which includes a capacitor, connected serially with the electrodes of the lamp, and a temperature-dependent resistor. In accordance with the invention, the temperature-dependent resistor is a positive temperature coefficient resistor and has connected in parallel thereto an additional starting capacitor. The circuit in series with the electrodes of the lamp, to preheat the lamp, thus will have a limiting capacitor and the parallel network of a starting capacitor and a positive temperature coefficient (PTC) resistor.

The capacity relationships of the limiting capacitor and the starting capacitor, in accordance with a feature of the invention, are approximately in the range of 1:1 to 5:1; preferably, the relationship is 2:1. The PTC resistor which bridges the starting capacitor has a low initial resistance.

The system has the advantage that, immediately upon energization of the circuit, a high preheating current will be provided to the heating electrodes of the lamp. This high preheating current, flowing through the lamp electrodes, rapidly heats the electrodes of the lamp. As the PTC resistor warms, its resistance increases; yet, high current continues to flow since the starting capacitor will become active to pass current therethrough. At the same time, the voltage on the lamp will rise, due to resonance, until the lamp ignites or fires. After firing, only the customary and ordinary lamp voltage will be across the two capacitors, so that the parallel current through the now serially connected capacitors will be small.

A desirable operating frequency for the lamp is in the range of between about 20 kHz and 500 kHz. This permits constructing the circuit with electronic components of minimum size, readily accomodated within the lamp base.

An additional advantage of the circuit is the very short ignition or firing time of only about ½ second. Consequently, upon energization, the lamp ignites almost immediately. The previously noticed connection flicker, or glow discharges of the lamp, which are disturbing and decrease the lifetime of the lamp, are entirely eliminated. At the same time, cold-starting of the lamp, which causes deterioration of the lamp as a whole, is avoided, so that the lifetime of the lamp is enhanced and the lamp components are protected. The voltage is automatically regulated, so the circuit is suitable for firing or igniting or starting fluorescent lamps under widely differing ambient temperature conditions.

DRAWINGS

Figure 1:
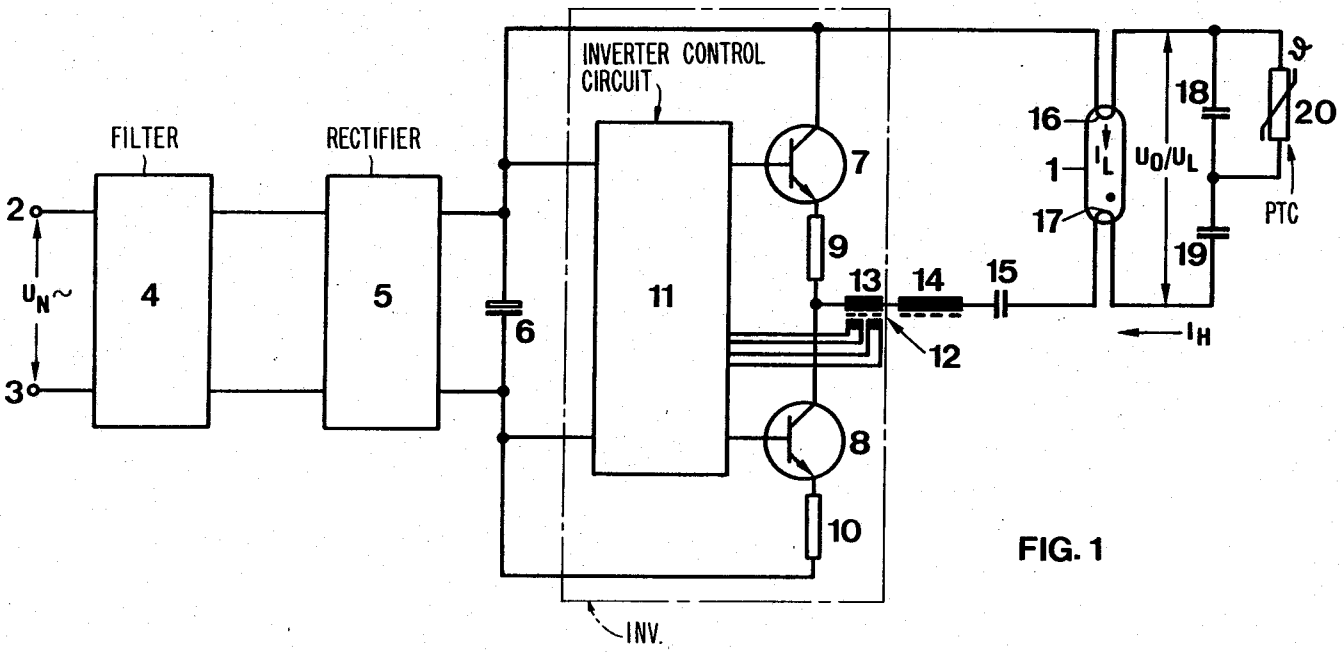
FIG. 1 is a general schematic circuit diagram of a fluorescent lamp in a starting and operating circuit.

DETAILED DESCRIPTION.

The lamp, with which the circuitry is described, may be, for example, a 15 W compact fluorescent lamp. Operating frequency for the supply voltage is 45 kHz.

The lamp 1 is supplied with power from a power network connected to terminals 2, 3, for example supplying 220 V, 50 Hz or 110 V, 60 kHz. The input voltage $U_N$ may be of any suitable power and frequency characteristics.

The input power is connected to a filter 4, and filtered alternating voltage is then supplied to a rectifier 5, for rectification, the output voltage of which is smoothed by a smoothing or filter capacitor 6. The filtered, smoothed voltage is applied to an inverter INV which includes, as primary operating components, two transistors 7, 8, having suitable emitter resistors 9, 10 and an inverter control circuit 11. The control voltage for the inverter INV is derived from a ring core transformer 12 which has a primary winding 13 of only a few turns. The primary winding 13 is connected in the operating circuit of the lamp 1. All the circuit elements so far described are conventional and may be dimensioned in accordance with well known circuitry. Specifically, the inverter control circuit may be of any well known arrangement, for example as described in the referenced literature.

The inverter INV generates an essentially rectangular voltage which, in the operating circuit, is applied to the lamp 1 through an inductance 14 and a blocking capacitor 15. The capacitor 15 simultaneously blocks direct current from the lamp and forms part of a resonant circuit. For operation at 45 kHz, the inductance 14 may, for example, be about 3 mH, and blocking capacitor 15 may have a capacity of about 47 nF.

An ignition and starting circuit is connected in parallel to the lamp 1 and serially to its heatable electrodes 16, 17. The starting circuit includes a current limiting capacitor 19. In accordance with the present invention, a circuit formed of a positive temperature coefficient (PTC) resistor 20 and a starting capacitor 18, in parallel, are connected serially with the limiting capacitor 19, as best seen in FIG. 1. The capacity of the starting capacitor 18, in the example given above, is about 3.3 nF, the capacity of the limiting capacitor 19 is 6.8 nF. The series circuit of the capacitors 18, 19 form a combined resonance capacitor $C_R$. The PTC resistor 20 may, for example, be of the type C890, made by SIEMENS AG.

Figure 2:
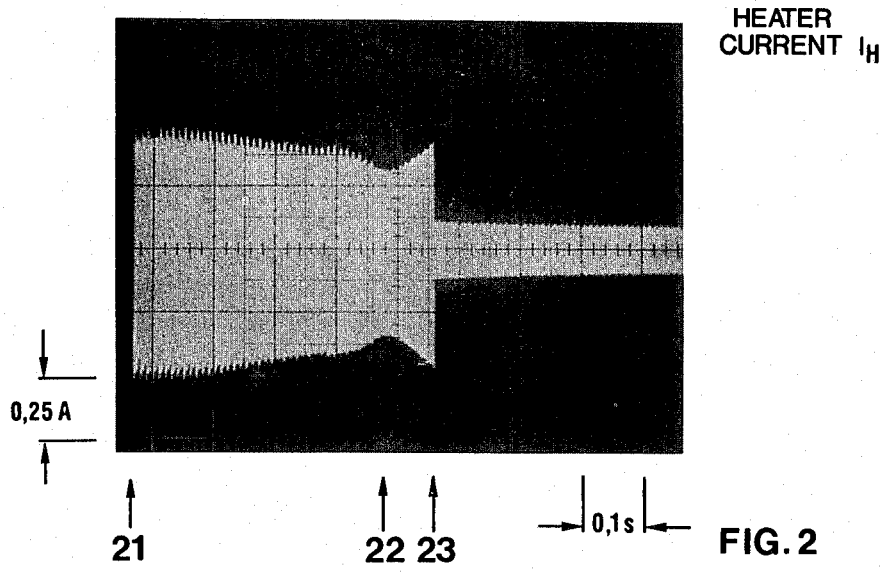
FIG. 2 is an oscillogram showing heating current with respect to time after energization of the lamp and its circuit.
Figure 3:
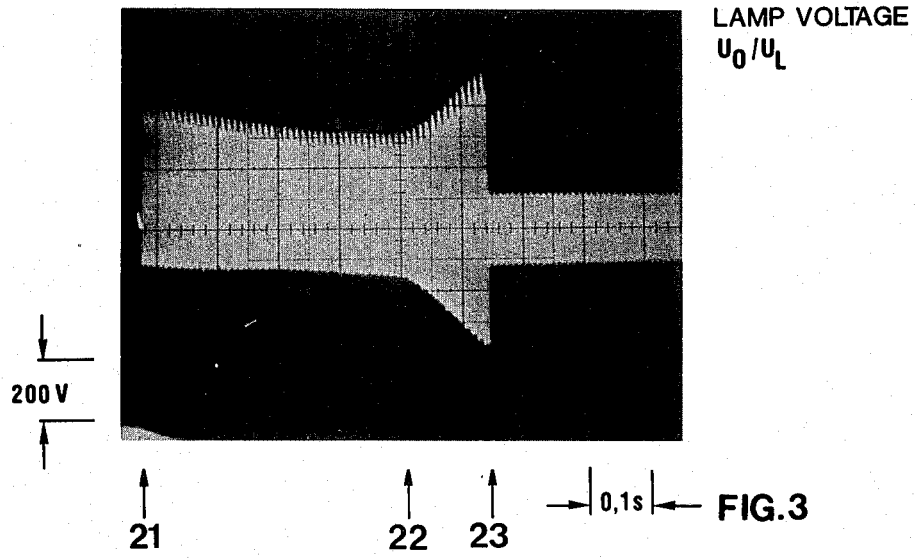
FIG. 3 is an oscillogram showing lamp voltage.
Figure 4:
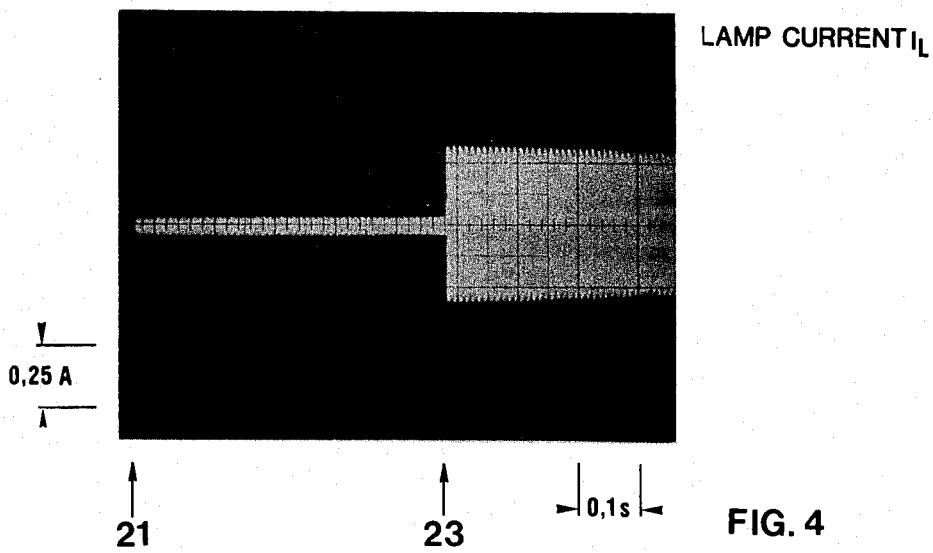
FIG. 4 is an oscillogram showing lamp current.

Operation, with reference to FIGS. 2–4

The lamp voltages $U_O$ and $U_L$, respectively, depending on whether the lamp has fired or not, are shown in FIG. 3; heater current $I_H$ through the electrodes 16, 17 is shown in FIG. 2, and lamp current $I_L$ is shown in FIG. 4.

At the instant of energization, point 21 in FIGS. 2–4, only capacitor 19 is actually connected in circuit across the lamp 1, since the resistance of the PTC resistor 20 is very low, and small with respect to the impedance of the capacitor. The smaller starting capacitor 18, which determines the level of the lamp supply voltage in operation, is effectively short-circuited or shunted by the PTC resistor 20 in its low-voltage condition. Current will flow through the electrodes 16, 17 of the lamp 1, which is considerable—see FIG. 2. An idle voltage across the lamp, $U_O$, will occur—see FIG. 3—the level of which is insufficient to fire the lamp due to the shunting of the capacitor 18 and the lower voltage on capacitor 19. The lamp current $I_L$ through the lamp is so small as to be, effectively, neglectable—see FIG. 4.

Upon continued current flow, and as the electrodes 16, 17 heat, current $I_H$ through the electrodes will drop slightly—see region in FIG. 2 between points 21 and 22. As the PTC resistor 20 heats, it becomes a high-resistance resistor and capacity of the starting capacitor 18 becomes effective. Thus, the overall capacity $C_R$ of the now effective series circuit of the two capacitors 18, 19 will be less than the capacity of capacitor 19 alone. The capacity values of the capacitors 18, 19 are so set that the desired high lamp supply voltage will be obtained, and the two capacitors 18, 19, in spite of their different capacity values, are loaded with roughly the same voltage. Combined with the inductance 14 and the blocking capacitor 15, the required resonance voltage will be obtained, see voltage 22, FIG. 3. As the resonance voltage 22 increases, the heater current $I_H$ will also rise again approximately to its initial value, as seen at point 23, FIG. 2.

Current $I_L$ through the lamp 1 has so far not been affected. The resonant idle voltage $U_O$ at the capacitors 18, 19 however increases—see FIG. 3—until the lamp 1 fires—indicated at point 23 in FIGS. 2–4.

A suitable and usual time between connecting of the circuit, point 21, and ignition, point 23, is only about ½ second.

After the lamp has fired, the characteristic lamp operating voltage $U_L$ will obtain. The lamp current $I_L$ will rise abruptly to its operating value—see FIG. 4—whereas the electrode current through the electrodes, that is, the preheat current $I_H$, drops, due to the low voltage of the serially connected capacitors 18, 19, to a value substantially below the preheat current value—see FIG. 2.

The FIGS. 2–4 are drawn to the same scale, with the time period of 0.1 second indicated.

Various changes and modifications may be made within the scope of the inventive concept.

We Claim:

1. Starting and operating circuit for a low-pressure discharge lamp, particularly compact fluorescent lamp (1), having two heatable electrodes (16, 17) located spaced from each other within a discharge vessel;

a current supply circuit including an inductance (13, 14) and a blocking capacitor (15) in series therewith, said current supply circuit being connected across the electrodes of the lamp;

and a starting circuit connected in parallel to the lamp, and in series with the heatable electrodes (16, 17) thereof, including a series circuit comprising a limiting capacitor (19) and a temperature-dependent resistor (20);

wherein, in accordance with the invention, the temperature-dependent resistor (20) is a positive temperature coefficient (PTC) resistor; and a starting capacitor (18) is provided, connected in parallel with the positive temperature coefficient resistor (20).

2. Circuit according to claim 1, wherein the ratio of the capacity values of the limiting capacitor (19) and the starting capacitor (18) is in the range of about 1:1 to 5:1.

3. Circuit according to claim 1, wherein the ratio of the capacity values of the limiting capacitor (19) and the starting capacitor (18) is about 2:1.

4. Circuit according to claim 1, wherein the current supply circuit provides operating power to the lamp (1) at a frequency of between about 20 kHz and 500 kHz.

5. Circuit according to claim 1, wherein the current supply circuit provides operating power to the lamp at about 45 kHz.

6. The combination of a compact fluorescent lamp (1) having heatable electrodes (16, 17), located spaced from each other within a discharge vessel, with a current supply circuit for said lamp connected to the heatable electrodes, said current supply circuit including an inductance (13, 14) and a blocking capacitor (15) in series therewith, said current supply circuit being connected across the electrodes of the lamp;

and a starting circuit connected in parallel to the lamp, and in series with the heatable electrodes (16, 17) thereof, including a series circuit comprising a limiting capacitor (19) and a temperature-dependent resistor (20);

wherein, in accordance with the invention, the temperature-dependent resistor (20) is a positive temperature coefficient (PTC) resistor; and a starting capacitor (18) is provided, connected in parallel with the positive temperature coefficient resistor (20).

7. The combination of claim 6, wherein the ratio of the capacity values of the limiting capacitor (19) and the starting capacitor (18) is in the range of about 1:1 to 5:1.

8. The combination of claim 6, wherein the ratio of the capacity values of the limiting capacitor (19) and the starting capacitor (18) is about 2:1.

9. The combination of claim 6, wherein the current supply circuit provides operating power to the lamp (1) at a frequency of between about 20 kHz and 500 kHz.

10. The combination of claim 6, wherein the current supply circuit provides operating power to the lamp at about 45 kHz.

* * * * *